US006007116A

United States Patent [19]

Mott

[11] Patent Number: 6,007,116

[45] Date of Patent: Dec. 28, 1999

[54] LATCHING MECHANISM

[75] Inventor: James Mott, Harrison Township, Mich.

[73] Assignee: Chrysler Corporation, Auburn Hills, Mich.

[21] Appl. No.: 09/164,675

[22] Filed: Oct. 1, 1998

[51] Int. Cl.[6] ..... E05C 1/04

[52] U.S. Cl. ..... 292/145; 292/153; 292/146; 292/DIG. 63; 292/341.17; 292/DIG. 38

[58] Field of Search ..... 292/145, DIG. 50, 292/146, 153, 120, 162, 304, DIG. 11, DIG. 45, DIG. 63, 341, 341.15, 340, 341.17, DIG. 38; 411/508, 509, 913, 41, 48, 46

[56] References Cited

U.S. PATENT DOCUMENTS

| | | | |
|---|---|---|---|
| 1,484,788 | 2/1924 | Keller | 292/DIG. 50 |
| 1,512,632 | 10/1924 | O'conner | 292/153 |
| 1,601,359 | 9/1926 | Harrington | 292/153 |
| 1,934,353 | 11/1933 | Jones | 292/304 |
| 2,244,344 | 6/1941 | North et al. | 292/340 |
| 2,775,799 | 1/1957 | Friderich | 292/341.15 |
| 4,186,952 | 2/1980 | Glass | 292/202 |
| 4,527,821 | 7/1985 | Tanaka | 292/19 |
| 4,952,160 | 8/1990 | Olsen | 439/142 |
| 4,981,322 | 1/1991 | Dowd et al. | 296/214 |
| 5,387,065 | 2/1995 | Sullivan | 411/48 |
| 5,478,126 | 12/1995 | Laesch | 292/87 |
| 5,624,142 | 4/1997 | Watson et al. | 292/241 |
| 5,630,630 | 5/1997 | Price et al. | 292/128 |
| 5,653,012 | 8/1997 | Pasternak et al. | 29/281.4 |
| 5,683,158 | 11/1997 | Lim | 312/326 |

*Primary Examiner*—Darnell M. Boucher
*Assistant Examiner*—John B. Walsh
*Attorney, Agent, or Firm*—James R. Yee

[57] ABSTRACT

A latching mechanism for selectively securing a movable panel to a stationary member. The latching mechanism includes a latch for attachment to the movable panel and a striker for attachment to the stationary member. The latch includes an actuation arm having a blade and a base plate defining an aperture. The striker includes a post having a bulbous end disposable in the aperture and a slot extending inwardly from the bulbous end. The actuation arm is coupled to the base plate for movement between an engaged position where the blade is operably disposed in the slot and a released position where the blade is operably removed from the slot.

7 Claims, 3 Drawing Sheets

LATCHING MECHANISM

BACKGROUND OF THE INVENTION

1. Technical Field

The present invention generally relates to a latching mechanism for securing a movable panel to a stationary member. More specifically, but without restriction to the particular embodiment and/or use which is shown and described for purposes of illustration, the present invention pertains to a glove box latch assembly for a motor vehicle.

2. Discussion

Automobiles have typically included at least one separate compartment for storage of personal items in the cabin of a vehicle. One of the most common compartments is a glove box generally including a door and a latching mechanism for securing the door to a stationary member or shell coupled to the instrument panel. One type of latching mechanism generally includes a housing, a push button or lever, a cam, a spring, and an engagement element separately assembled into a latch subassembly. The latch subassembly is subsequently mounted to the glove box door. A striker plate is separately mounted to a fixed portion of the shell.

While the latching mechanism previously described effectively couples the glove box door to the shell, it requires a large number of components to perform a relatively simple function. The manufacture and subsequent assembly of a latch assembly containing a large number of components are time consuming and costly.

In view of the above concerns as well as the manufacturer's ever present desire to reduce manufacturing costs and complexity, a need exists for a glove box latch that may be easily and inexpensively manufactured and installed.

SUMMARY OF THE INVENTION

It is a general object of the present invention to provide an improved latching mechanism for selectively securing a movable panel to a stationary member.

In one form, the present invention provides a latching mechanism for selectively securing a movable panel to a stationary member. The latching mechanism includes a latch for attachment to the moveable panel and a striker for attachment to the stationary member. The latch includes an actuation arm having a blade and a base plate defining an aperture. The striker includes a post having a bulbous end disposable in the aperture and a slot extending inwardly from the bulbous end. The actuation arm is coupled to the base plate for movement between an engaged position wherein the blade is operably disposed in the slot and a released position wherein the blade is operably removed from the slot.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
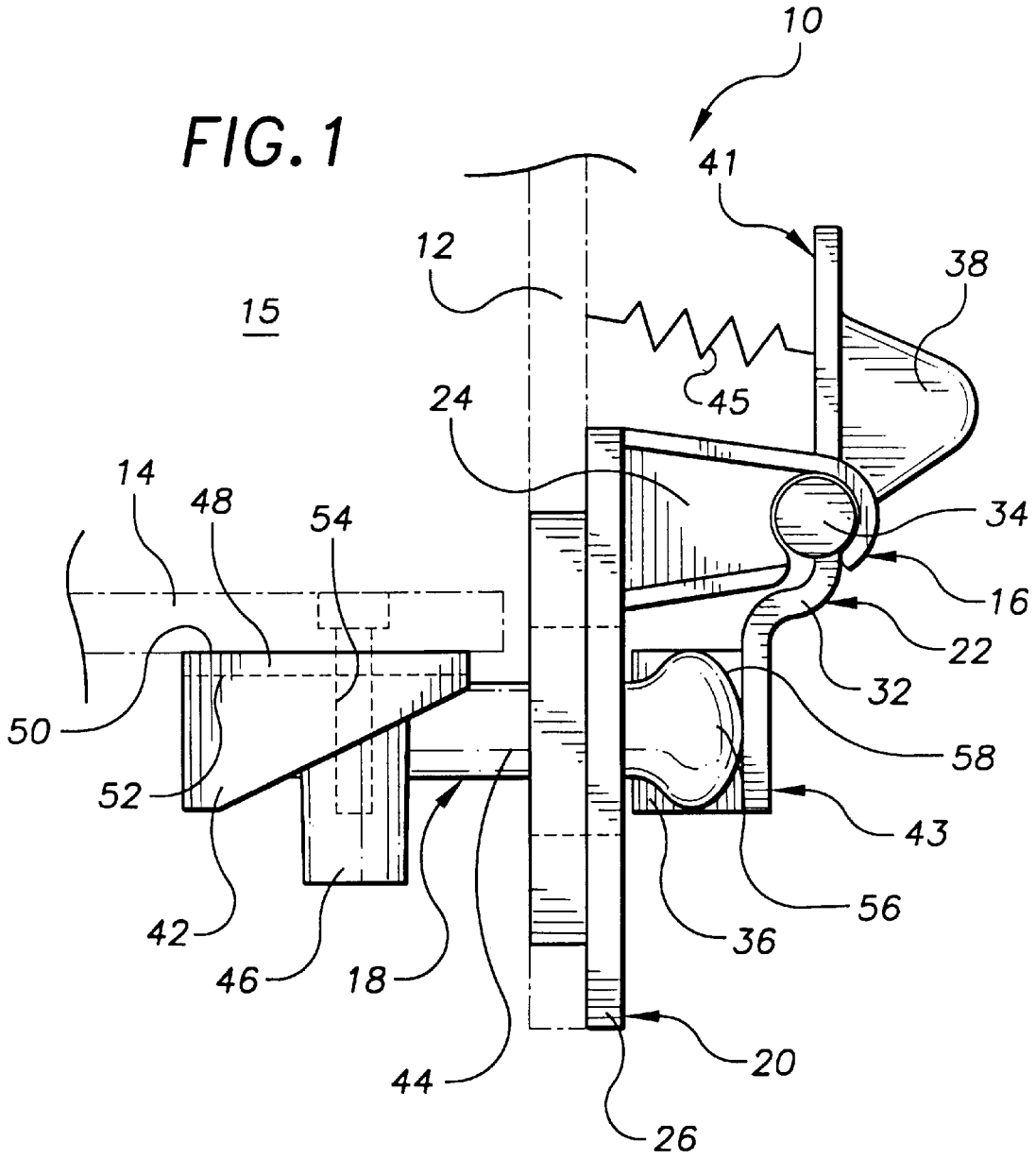
FIG. 1 is a side view of a latching mechanism constructed in accordance with the teachings of a preferred embodiment of the present invention, the latching mechanism shown in a latched condition operatively coupling a movable panel to a fixed panel.

With reference to the drawings, a latching mechanism constructed in accordance with the teachings of a preferred embodiment of the present invention is generally identified with reference numeral 10. The latching mechanism 10 of the present invention is illustrated selectively securing a glove box door or movable panel 12 to a stationary member or shell 14 providing a closure for a glove box compartment or cavity 15. The latching mechanism 10 is shown to generally include a latch 16 fixed to movable panel 12 and a striker 18 fixed to stationary member 14. The latch 16 includes a base plate 20 and an actuation arm 22 coupled to base plate 20 for pivotal movement relative thereto between an engaged position (shown in FIGS. 1 and 3 (solid lines)) and a released position (shown in phantom lines in FIG. 3) wherein the actuation arm 22 is rotated.

Figure 3:
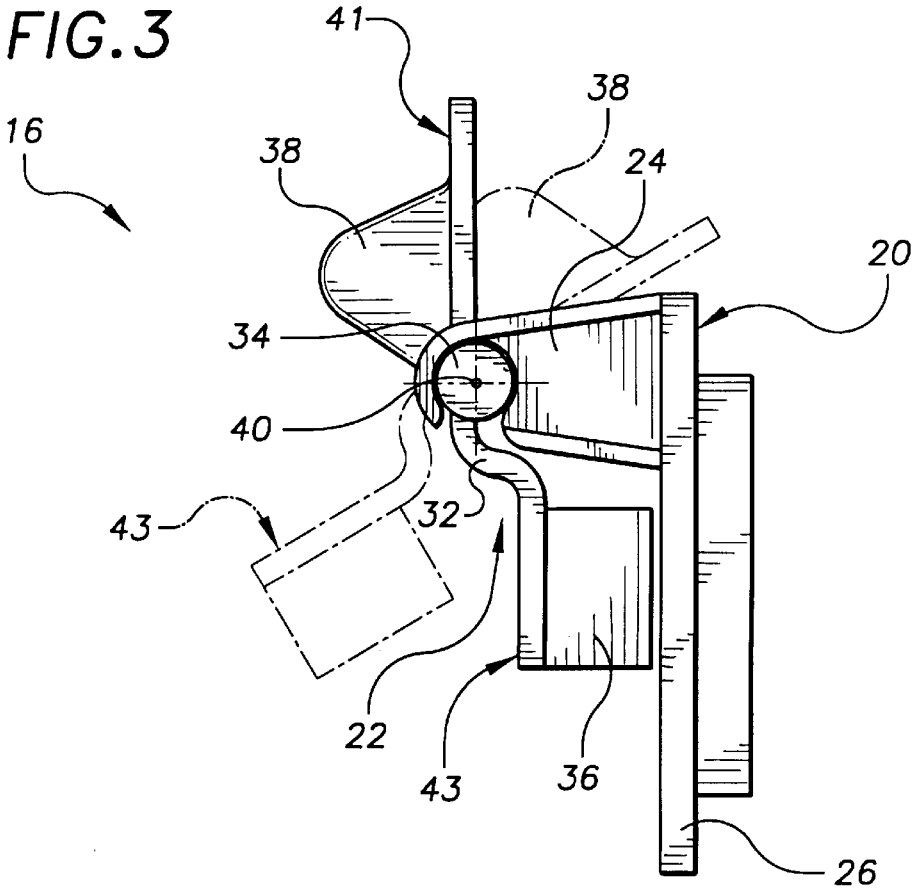
FIG. 3 is a side view of the latch portion of FIG. 2.
Figure 4:
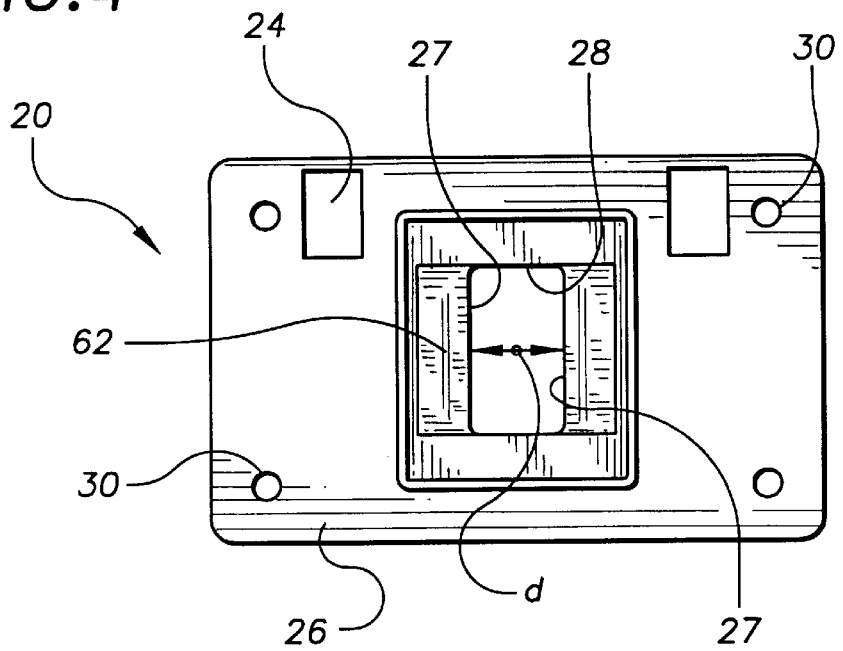
FIG. 4 is a rear view of the latch portion of the latching mechanism of FIG. 1.

As particularly shown in FIGS. 3 and 4, the base plate 20 includes stanchions 24 extending from a foundation 26. The foundation 26 includes side walls 27 defining an aperture 28 of width d for accommodating the striker 18, as shown in FIG. 1. The base plate 20 further includes a plurality of mounting holes 30 for securing base plate 20 to the movable panel 12. Those skilled in the art will appreciate that base plate 20 may be stamped or integrally formed with movable panel 12 or connected thereto via a spot weld, rivet, bolt, or other type of connection well known in the art.

Figure 2:
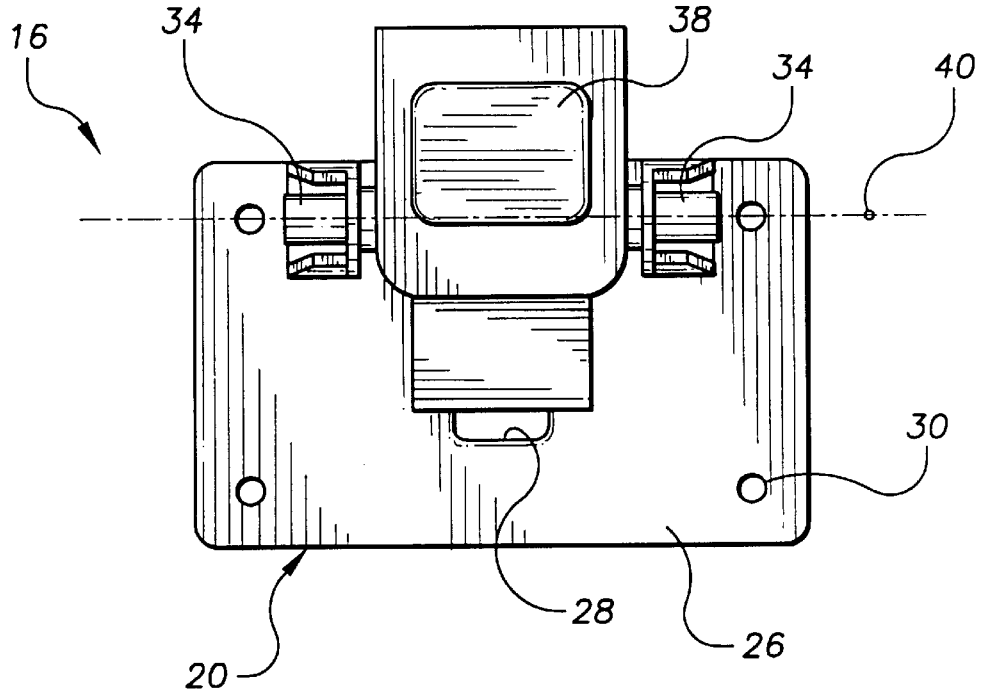
FIG. 2 is a front view of the latching mechanism of FIG. 1.

Referring specifically to FIGS. 2 and 3, actuation arm 22 includes a body 32, trunions 34 and a button 38. The trunions 34 protrude from body 32 along axis of rotation 40 dividing the body 32 into first and second ends, 41 and 43, respectively. Preferably, the axis of rotation 40 is located at the center of gravity of actuation arm 22. Placing the axis 40 along the center of gravity of the actuation arm 22 reduces the moment induced by external accelerations such as when the vehicle encounters a pothole in a road. Positioning the axis 40 in this manner thereby reduces the likelihood of the glove box inadvertently opening during vehicle operation. Actuation arm 22 further includes a blade 36 extending from the second end 43 of the body 32. The blade 36 functions as a locking element within the latching mechanism 10 which will be described in detail hereinafter.

The button 38 protrudes from body 32 proximate to the first end 41 to provide an operator a convenient method of inducing rotation to actuation arm 22. One skilled in the art will appreciate that the button 38 may be replaced with a lever or handle (not shown) capable of inducing a moment to the actuation arm 22 about the axis of rotation 40.

As shown in FIG. 1, the actuation arm 22 further includes a biasing member in the form of a spring 45 coupled to body 32 and movable panel 12. Those skilled in the art will appreciate that the spring 45 urges the first end of body 32 away from the movable panel 12. As a result, the actuation arm 22 is rotated about axis 40 toward the engaged position.

Figure 5:
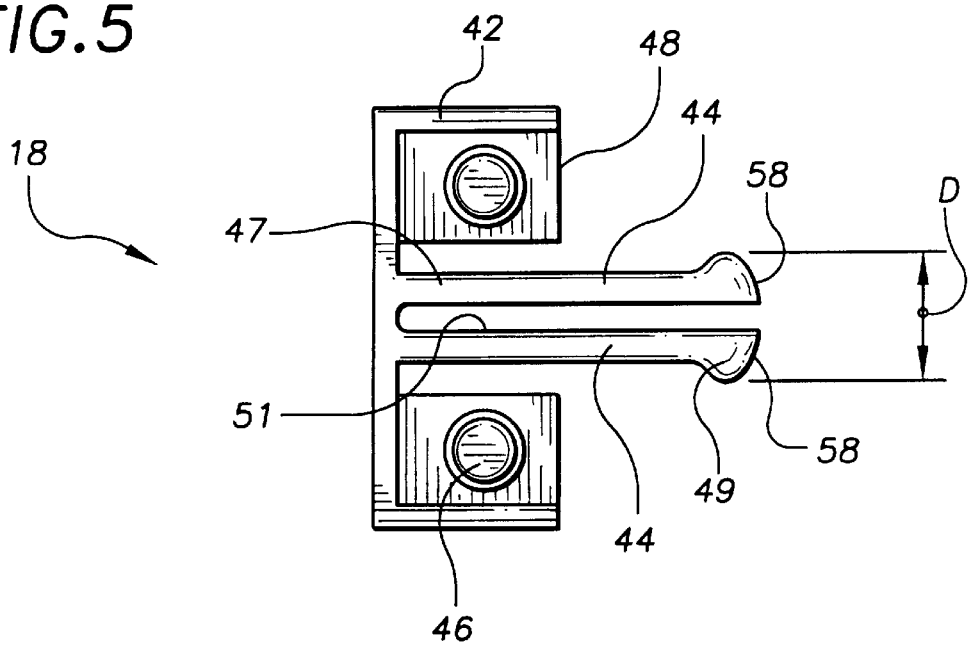
FIG. 5 is a bottom view of a striker portion of the latching mechanism of FIG. 1.

Referring to FIGS. 1 and 5, the striker 18 is shown to include a post 47, a bracket 42 and retainers 46. The bracket 42 includes a mounting flange 48 having an upper surface 50 and a lower surface 52. The upper surface 50 of the striker 18 is coupled to the stationary member 14 as shown in FIG. 1. Each of retainers 46 extend from a lower surface 52 defining a fastener receptacle 54. A thread forming fastener (not shown) may be driven into the fastener receptacle 54 to secure the striker 18 to the stationary member 14 in a cost efficient manner. One skilled in the art will appreciate that while the striker 18 is illustrated and described herein as including retainers 46, other coupling components generally known in the art may be used with the present invention. More particularly, it is contemplated that the striker 18 may be integrally formed to the stationary member 14 or coupled to the stationary member 14 using conventional fastening means.

The post 47 includes a first end coupled to bracket 42, a bulbous end 49 and a slot 51 extending from the bulbous end 49 towards the first end to define a pair of cantilevered legs 44. As shown in FIG. 5, bulbous end 49 includes an insertion face 58 and defines a width D that is normally greater than the aperture width d when legs 44 are in an undeformed state as shown in FIG. 5.

Beginning at an unlatched position with the compartment 15 open, the function of the latching mechanism 10 will be described. As the movable panel 12 is rotated from an unlatched or open position toward a closed or latched position shown in FIG. 1, a guide face 62 of base plate 20 is brought into contact with the insertion face 58 such that cantilevered legs 44 are forced to move toward one another. The space between legs 44, previously defined as the slot 51, is reduced until the bulbous end 49 enters the aperture 28. After the bulbous end 49 clears the sidewalls 27, both the legs 44 and the slot 51 return to the undeformed state shown in FIG. 5. The spring 45 urges the blade 36 between the legs 44 to complete the latching operation as shown in FIG. 1 and maintains the engaged position absent manipulation of the actuation arm 22. While in the engaged position, the blade 36 prevents the legs 44 from moving toward one another when an opening force is applied to the movable panel 12. As such, the bulbous end 49 maintains a width substantially equal to dimension D (FIG. 5) and is unable to pass through the aperture 28 in an opening direction.

Unlatching is facilitated by manually applying an external force to the actuation arm 22 and rotating the arm 22 about the axis 40 into the released position previously described and shown in FIG. 3. Once the arm 22 is in the released position, the blade 36 is no longer positioned between the legs 44. Accordingly, only a small force, in the order of 2–10 pounds, is required to move the legs 44 toward one another allowing the bulbous end 49 to pass through aperture 28 and open the compartment.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A closure comprising:

a first member;

a second member, said second member coupled to said first member for pivotal movement relative thereto between an open position and a closed position, said first and second members defining a compartment; and a latching mechanism for selectively preventing movement of said second member relative to said first member when said second member is in said closed position, said latching mechanism including a striker fixed to one of said first and second members and a latch coupled to the other of said first and second members, said latch defining an aperture and including an actuation member, said striker having a tip with a maximum width greater than said aperture, said tip normally adapted to resiliently compress upon insertion into and withdrawal from said aperture, said actuation member adapted to selectively engage said tip and prevent resilient compression thereof such that withdrawal of said tip from said aperture is in turn prevented.

2. The closure of claim 1, wherein said striker is fixed to said first member and said actuation arm is coupled to said second member.

3. The closure of claim 1, wherein said striker includes a pair of cantilevered legs defining a bulbous end disposable in said aperture and a slot extending inwardly from said bulbous end.

4. The closure of claim 3, wherein said actuation member includes a blade selectively insertable into said slot for preventing resilient compression of said bulbous end.

5. A glove box, comprising:

a first member;

a second member, said second member coupled to said first member for movement relative thereto between an open position and a closed position, said first and second members defining a compartment; and a latching mechanism for selectively preventing movement of said second member relative to said first member when said second member is in said closed position, said latching mechanism including a striker fixed to one of said first and second members and a latch coupled to the other of said first and second members, said latch defining an aperture and including an actuation member, said striker having a tip with a maximum width greater than said aperture, said tip normally adapted to resiliently compress upon insertion into and withdrawal from said aperture, said actuation member adapted to selectively engage said tip and prevent resilient compression thereof such that withdrawal of said tip from said aperture is in turn prevented.

6. A closure comprising:

a first member;

a second member, said second member coupled to said first member for movement relative thereto between an open position and a closed position, said first and second members defining a compartment; and a latching mechanism for selectively preventing movement of said second member relative to said first member when said second member is in said closed position, said latching mechanism including a striker fixed to one of said first and second members and a latch coupled to the other of said first and second members, said latch defining an aperture and including an actuation member, said striker having a tip with a maximum width greater than said aperture and including a pair of cantilevered legs defining a bulbous end disposable in said aperture and a slot extending inwardly from said bulbous end, said actuation member being pivotally coupled to said second member for rotation about an axis of rotation, said tip normally adapted to resiliently compress upon insertion into and withdrawal from said aperture, said actuation member adapted to selectively engage said tip and prevent resilient compression thereof such that withdrawal of said tip from said aperture is in turn prevented.

7. The closure of claim 6, wherein said actuation member has a center of gravity located on said axis of rotation.

* * * * *